US005610358A

United States Patent [19]

Eagar et al.

[11] Patent Number: 5,610,358

[45] Date of Patent: Mar. 11, 1997

[54] APPARATUS AND PROCESS FOR EXPLOSIVES BLOW LOADING

[75] Inventors: Simon E. Eagar, Beecroft; Andrew D. Hunter, Toronto, both of Australia

[73] Assignee: ICI Australia Operations Proprietary Limited, Australia

[21] Appl. No.: 566,861

[22] Filed: Dec. 4, 1995

[30] Foreign Application Priority Data

Dec. 2, 1994 [AU] Australia ..... PM 9809

[51] Int. Cl.[6] ..... F42B 3/00; F42B 4/00

[52] U.S. Cl. ..... 86/21; 86/20.15; 102/313

[58] Field of Search ..... 86/20.15; 102/21, 102/313

[56] References Cited

U.S. PATENT DOCUMENTS

| | | | |
|---|---|---|---|
| 3,063,373 | 11/1962 | Boddorff et al. | 102/313 X |
| 3,541,797 | 11/1970 | Stewart | 86/20.15 X |
| 4,699,060 | 10/1987 | Vuillaume | 102/313 |
| 4,987,818 | 1/1991 | Alford | 86/20.1 X |
| 5,007,345 | 4/1991 | O'Garb | 102/313 |
| 5,251,531 | 10/1993 | Miehling | 86/21 |

*Primary Examiner*—Peter A. Nelson

[57] ABSTRACT

The application relates to a gas deflecting device for use in the blow loading of emulsion explosives compositions, the gas deflecting device comprising a nozzle which is capable of being removably attached to a blow loading hose, the nozzle comprising at least one vent and at least one vane along its length, the vane being adapted to allow free escape of gas from the nozzle through the vent but inhibit the exit of explosive composition through the vents during blow loading. The application also provides a process for blow loading a blasthole with explosives compositions the process comprising the steps of, (a) connecting a nozzle at or near the end of a blow loading hose, said nozzle comprising at least one vent and at least one vane along its length, said vane being adapted to allow gas to escape from the nozzle through the vent but inhibit the exit of explosive composition through the vent during blow loading, (b) positioning the nozzle at or near the collar of a blasthole, and (c) blowing explosives composition through the hose and the nozzle into the blasthole.

11 Claims, 2 Drawing Sheets

APPARATUS AND PROCESS FOR EXPLOSIVES BLOW LOADING

Figure 1:
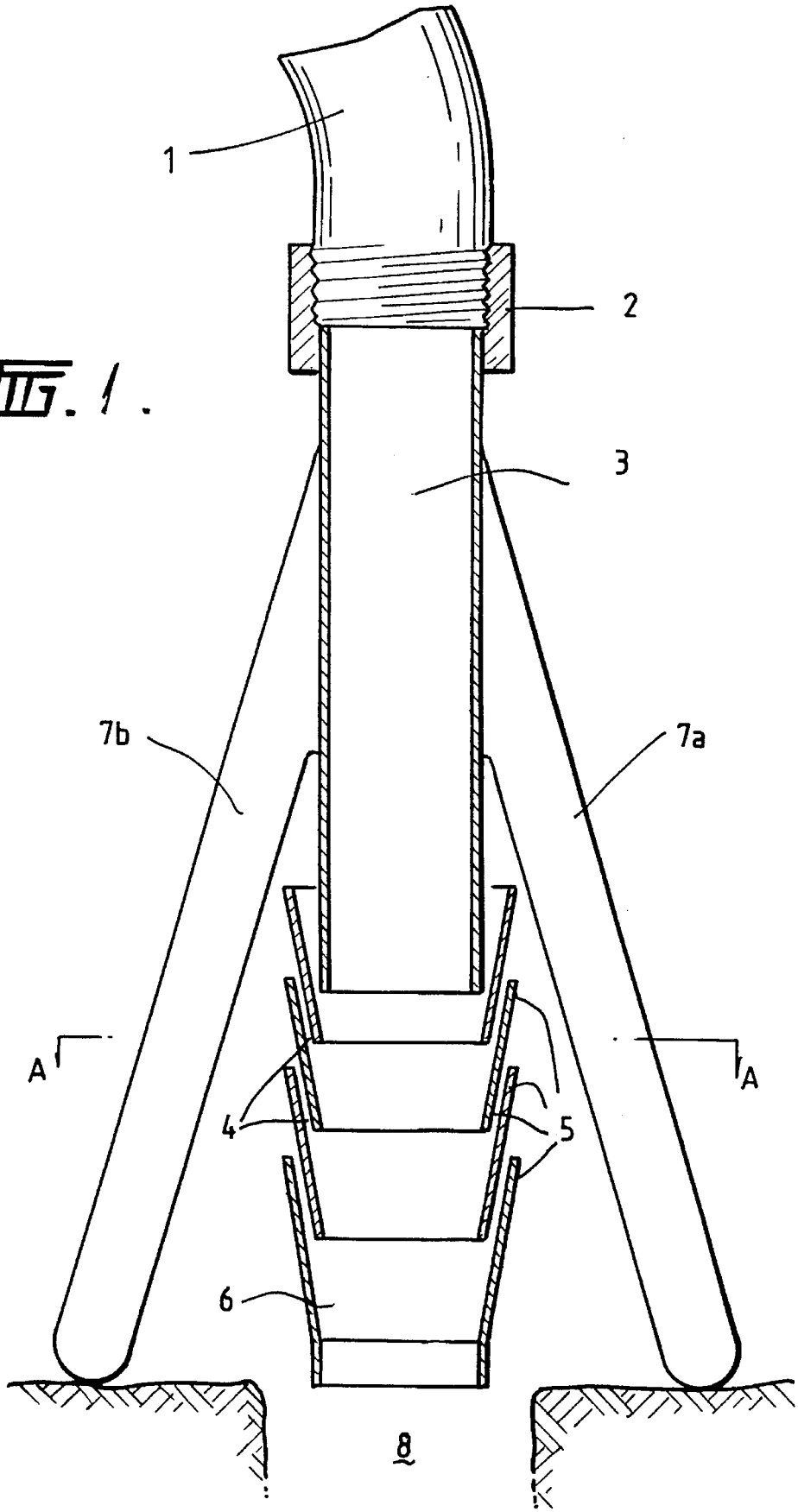

This invention relates to an apparatus and process for blow loading of emulsion explosives compositions, particularly those comprising solid particulate matter and emulsion.

The mining and quarrying industries need to break and move millions of tonnes of earth and ore each year and explosives are the most economically efficient method doing this. When explosives are used in the mining industry, rock is fractured by drilling blastholes then filling them with bulk or packaged explosive compositions which are subsequently detonated. The three main types of bulk explosive compositions in use for civilian blasting operations are simple mixtures of oxidiser salts and fuel, water-in-oil emulsion explosives and mixtures thereof.

Explosive compositions comprising particulate oxidiser salts and a fuel have been known for many years as relatively inexpensive and reliable explosives and the most commonly used of these is ANFO, a mixture of ammonium nitrate (AN) and about 6% w/w fuel oil (FO).

Water-in-oil emulsion explosives compositions were first disclosed by Bluhm in U.S. Pat. No. 3,447,978 and comprise (a) a discontinuous aqueous phase comprising discrete droplets of an aqueous solution of inorganic oxygen-releasing salts; (b) a continuous water-immiscible organic phase throughout which the droplets are dispersed and (c) an emulsifier which forms an emulsion of the droplets of oxidizer salt solution throughout the continuous organic phase. They may also include sensitizing agents such as a discontinuous gaseous phase.

In order to take advantage of the low cost of ANFO and the superior water resistance of emulsions, ANFO and emulsions have been blended together to provide explosives which are now widely used in the industry and referred to as "heavy ANFO's". Compositions comprising blends of water-in-oil emulsion and AN or ANFO are described, for example in Australian Patent Application No. 29408/71 (Butterworth) and U.S. Pat. Nos. 3,161,551 (Egly et al) and 4,357,184 (Binet et al).

Where large quantities of bulk explosive are required they are often mixed on-site in manufacturing units located on trucks (called mobile manufacturing units or MMU's) and then loaded into the blastholes. The MMU's comprise containers in which precursors of explosives compositions are stored separately until being mixed together using a mixing device. For example, MMU's can be used to mix AN and fuel oil to provide ANFO, emulsion and ANFO to provide heavy ANFO. MMU's may also comprise a means for forming the emulsion and Australian Patent No. 42838/85 describes such an MMU which has a blender means for blending an aqueous oxidiser salt solution, emulsifier and liquid organic fuel to form a water-in-oil emulsion.

MMU's also comprise systems for delivery of bulk explosive compositions into blastholes. This is carried out by one of three main methods namely pouring, pumping or blow loading, the method used depending on the type of product. Some compositions have physical characteristics which make them suitable for being poured or augured out of a receptacle on the MMU straight down a blasthole. Pouring is not a suitable delivery method for small diameter holes.

Some compositions are best adapted to being pumped by mechanical or pneumatic means out of an MMU and through a delivery hose into the blastholes. To be pumped an explosive composition must be sufficiently liquid and insensitive to initiation. Explosives compositions which are very dense and viscous and can only be pumped through short hoses; they cannot be pumped through long hoses without the use of excessively high pumping pressures or the hoses simply block up.

Blow loading of an explosive composition typically involves the use of compressed gas to blow the explosive through a delivery hose into blastholes. Blow loading of AN and ANFO has been used since the 1960's and is described in Australian Patent No.s 441775 (Fox), 466558 (Persson), 469494 (Bizon & Simpson) and 474509 (Hay & Fox).

Blow loading is a particularly preferred method of loading explosives at most mine sites because the MMU's can be parked to one side of a pattern of blastholes and the long blowloading hoses (typically 15 meters long and 64 millimeters diameter) extended across the blast pattern to load the holes with explosive compositions. This method of loading is preferable to other methods of loading because MMU's which auger or pump have to be moved onto a blasthole pattern close to the holes to be filled and they often crush and close the blastholes as they are driven over them.

Blow loading utilises large volumes of gas to blow the explosive composition through the delivery hose into the blasthole. One of the problems associated with blow loading of heavy ANFO type compositions is that the gas expelled from the end of the delivery hose into blastholes hits the bottom and sides of the blasthole and is deflected back out towards the hose operator, who stands at the collar of the blasthole holding the delivery hose. This not only creates uncomfortable working conditions for the operator but also creates a safety hazard if the back deflection of gas is dislodging dust and small particles of earth from in and around the blasthole and causing them to fly up at the operator.

The present invention provides a device for use during blow loading of explosive compositions such as heavy ANFO to prevent the operator and others at the collar of the blasthole from being subjected to the effects of back deflection of the blow loading gas. The present invention therefore provides, a gas deflecting device for use in the blow loading of emulsion explosives compositions comprising a nozzle which is capable of being removably attached to a blow loading hose, the nozzle comprising vents and vanes along its length, said vanes being adapted to allow gas to escape from the nozzle through the vents but inhibit the exit of explosive composition through the vents during blow loading.

The current invention further provides a process for blow loading a blasthole with explosives compositions comprising:

(a) connecting a nozzle at or near the end of a blow loading hose, said nozzle comprising at least one vent and at least one vane along its length, said vane being adapted to allow gas to escape from the nozzle through the vent but inhibit the exit of explosive composition through the vent during blow loading, (b) positioning the nozzle at or near the collar of a blasthole, and (c) blowing explosives composition through the hose and the nozzle into the blasthole.

Attachment of the nozzle to the hose can be achieved by any convenient means such as screw threaded or bayonet fittings. In use, explosives composition is pneumatically transported or "blown" through the hose and the nozzle. The nozzle is located at or near the collar of the blasthole such that explosives composition blown out the nozzle is deposited in the blasthole, thus filling or "loading" the blasthole. As the explosives composition is pneumatically transported through the nozzle into the blasthole, some or all of the air or other gas used in the pneumatic transport exits the nozzle through the vents, the device being conformed such that the vanes inhibit exit of the explosive composition through the vents.

The vanes of the deflection device of the current invention may be of any convenient shape but it is desirable that the vanes interfere as little as possible with the flow of explosive composition through the nozzle into the blasthole. In a preferred embodiment the vanes are frustro-conical in shape. Where two or more vanes are to be used it is particularly preferred that the base of each frustro-conical member overlaps the upper part of an adjacent frustro-conical member, the space between each pair of vanes defining the vent. The vanes may be fixed, or moveable so as to provide some flexibility in directing the outflow or gas from the nozzle. The nozzle may be of any convenient length and the openings and vanes located at any convenient position but they are preferably located near the outlet end of the nozzle.

In a preferred embodiment one or more support members are provided so that the nozzle can be positioned at the collar of a blasthole and stand alone without being held by an operator or other form of support. The support members may comprise brackets, feet or other devices of any convenient shape located where appropriate on the nozzle. The support member may comprise a single frustro-conically shaped member which surrounds the nozzle like a skirt. The support member may also act to further deflect the gas passing out of the nozzle through the vents.

A preferred embodiment of the process and device of the current invention will now be further described with reference to delivery of an explosives composition into a blasthole with reference to FIG. 1, which is a section view of an embodiment of the device of the current invention and FIG. 2 which is a cross sectional view along AA' of FIG. 1.

FIG. 1 shows a conduit (1) for the passage of transport gas and explosives composition optionally including solid particulate matter. The conduit is connected by a screw fitting (2) to a nozzle (3). The nozzle comprises vents (4) and vanes (5) at the end nearest its outlet (6). The vanes are frustro-conical in shape, the base of each frustro-conical vane overlapping the upper part of an adjacent frustro-conical vane, the space between each pair of vanes defining the vent. The nozzle outlet is positioned over the collar of a blasthole (8) and can stand alone, balanced on a support member comprising four support brackets (7), two of which are shown in the diagram. Explosive composition formed on an MMU is blow loaded along the conduit, through the nozzle and into the blasthole. The pressurised gas used for projecting the explosives composition along the conduit passes out through the vents in the nozzle, the vanes acting to direct the gas flow.

Figure 2:
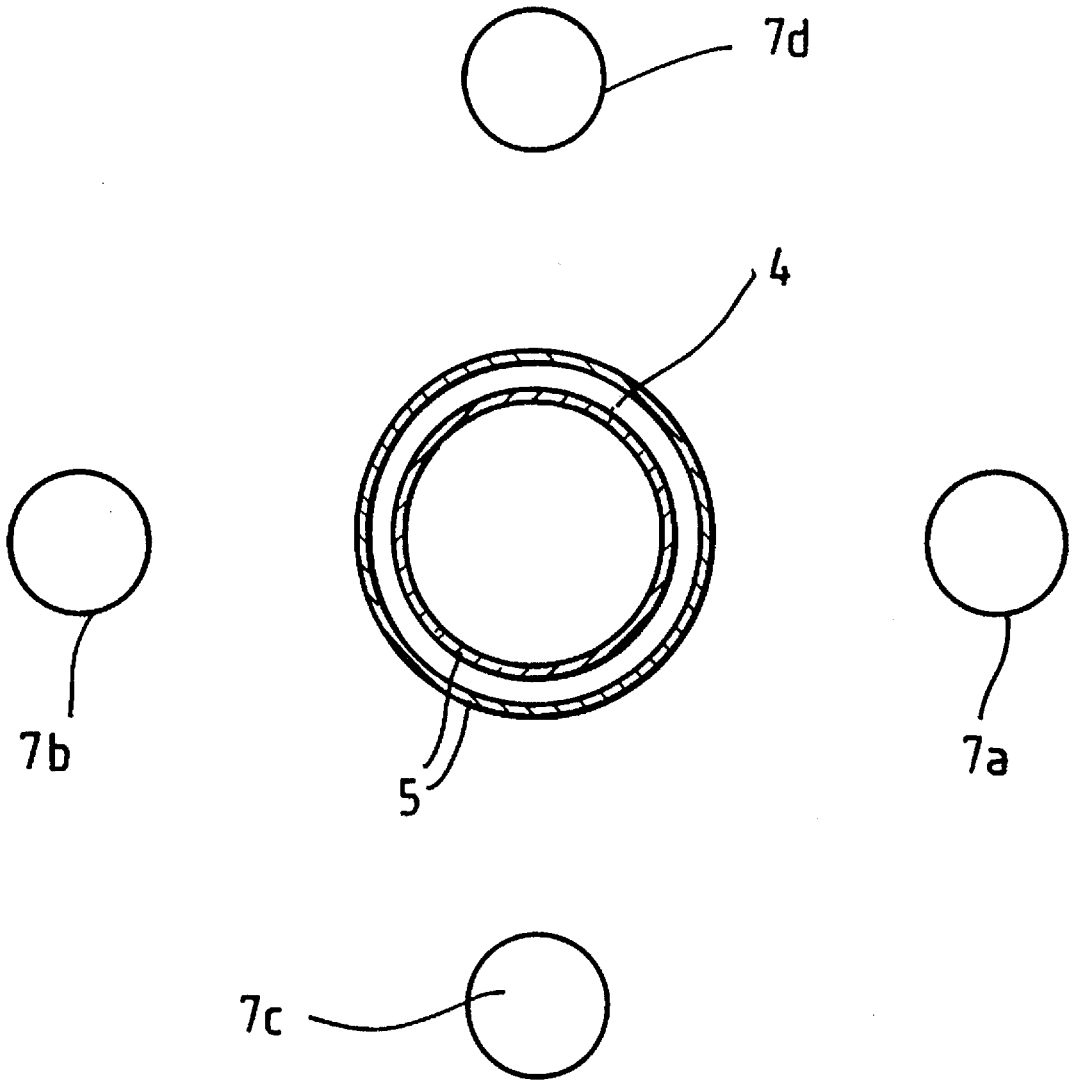

FIG. 2 is a cross sectional view along AA' of FIG. 1 and shows two vanes (5) and the space between them which defines the vent (4). The four brackets (*7a, 7b, 7c* and *7d*) forming the support member are evenly spaced to maintain balance and avoid the device tipping over.

While the apparatus and process of the current invention is suitable for blow loading of emulsion explosives compositions it will be apparent to those skilled in the art that the deflector could be used in other pneumatic conveying applications.

While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

We claim:

1. A gas deflecting device for use in the blow loading of emulsion explosives compositions comprising a nozzle which is capable of being removably attached to a blow loading hose, the nozzle comprising at least one vent and at least one vane along its length, said vane being adapted to allow free escape of gas from the nozzle through the vent but inhibit the exit of explosive composition through the vents during blow loading.

2. A gas deflecting device according to claim 1 comprising two or more vanes wherein the vanes are frustro-conical in shape, the base of each frustro-conical vane overlapping the upper part of an adjacent frustro-conical vane, the space between each pair of frustro-conical vanes defining the vent.

3. A gas deflecting device according to claim 1 wherein the vents and vanes are located near the outlet end of the nozzle.

4. A gas deflecting device according to any of claim 1 wherein the vanes are fixed or moveable.

5. A gas deflecting device according to any of claim 1 which further comprises a support member such that the nozzle can stand without additional support.

6. A gas deflecting device according to claim 5 wherein the support member is frustro-conical in shape.

7. A gas deflecting device according to claim 5 wherein the support member comprises four brackets.

8. A process for blow loading a blasthole with explosives compositions comprising, (a) connecting a nozzle at or near the end of a blow loading hose, said nozzle comprising at least one vent and at leas one vane along its length, said vane being adapted to allow gas to escape from the nozzle through the vent but inhibit the exit of explosive composition through the vent during blow loading, (b) positioning the nozzle at or near the collar of a blasthole, and (c) blowing explosives composition through the hose and the nozzle into the blasthole.

9. A process for blow loading a blasthole according to claim 8 wherein the explosives composition comprises a combination of water-in-oil emulsion and particulate oxidiser salt.

10. A process for blow loading a blasthole according to claim 8 wherein the explosives composition comprises a combination of water-in-oil emulsion and a mixture of particulate oxidiser salt and hydrocarbon oil.

11. A process according to claim 9 wherein the particulate oxidiser salt is ammonium nitrate.

* * * * *